United States Patent [19]

Gölz

[11] 4,239,460

[45] Dec. 16, 1980

[54] CRYOGENIC PUMP FOR LIQUID GASES

[75] Inventor: Roland Gölz, Ecublens, Switzerland

[73] Assignee: Socsil S.A., Ecublens, Switzerland

[21] Appl. No.: 943,625

[22] Filed: Sep. 19, 1978

[30] Foreign Application Priority Data

Oct. 19, 1977 [CH] . Switzerland ..... 12733/77

[51] Int. Cl.[3] ..... F04B 3/00; F04B 25/02

[52] U.S. Cl. ..... 417/251; 417/258; 417/259; 417/901

[58] Field of Search ..... 417/258, 251, 259, 488, 417/487, 523, 528, 901

[56] References Cited

U.S. PATENT DOCUMENTS

| | | | |
|---|---|---|---|
| 39,974 | 9/1863 | Virdin | 417/258 |
| 905,640 | 12/1908 | Borchers | 417/258 |
| 2,880,927 | 4/1959 | Ploegert | 417/258 |
| 2,931,313 | 4/1960 | Hughes | 417/901 |
| 3,023,710 | 3/1962 | Tyree | 417/259 |
| 3,145,629 | 8/1964 | Gotzmann | 417/901 |
| 3,254,607 | 6/1966 | Norton | 417/901 |
| 3,263,622 | 8/1966 | Tyree | 417/901 |
| 4,053,089 | 10/1977 | Gamadia | 417/245 |

FOREIGN PATENT DOCUMENTS

| | | | |
|---|---|---|---|
| 1149030 | 5/1963 | Fed. Rep. of Germany | 417/901 |

*Primary Examiner*—William L. Freeh

*Attorney, Agent, or Firm*—Young & Thompson

[57] ABSTRACT

The invention relates to a cryogenic pump for liquid gases which comprises, within a housing, a cylinder connected to the supply of liquified gas through a non return valve and to an overflow duct. A movable piston is displaceble within this cylinder defining a suction chamber and an evacuation chamber and this piston carries a skirt cooperating with a piston rigidly fixed to the frame defining together a compression chamber. This compression chamber is connected through a non return valve to the high pressure output of the pump and to the suction chamber by means of at least one passage provided with a non return valve.

4 Claims, 4 Drawing Figures

CRYOGENIC PUMP FOR LIQUID GASES

There are numerous pumps for liquified gases, which all are of the piston type, but which do not give complete satisfaction. In fact unless the pump is heat insulated and cooled to the liquified gas temperature, and this is not always sufficient, these pumps very easily lose their prime. In fact, on the suction side of the pump, a depression is created which favours the vaporization of the gas filling a portion of the compression chamber with a compressible fluid which causes rapidly the loss of prime of the pump.

The present invention has for its object a pump for liquified gases which tends to remedy to the precited drawbacks by the fact that it comprises within a housing a cylinder connected to the supply of liquified gas through a non return valve and to an overflow duct, by the fact that a movable piston is displacable within this cylinder defining a suction chamber and an evacuation chamber, by the fact that this piston carries a skirt cooperating with a piston rigidly fixed to the frame defining together a compression chamber connected through a non return valves to the high pressure output of the pump and by the fact that the compression chamber is connected to the suction chamber by means of at least one passage provided with a non return valve.

The attached drawings show shematically and by way of example one embodiment of the pump according to the invention.

Figure 1:
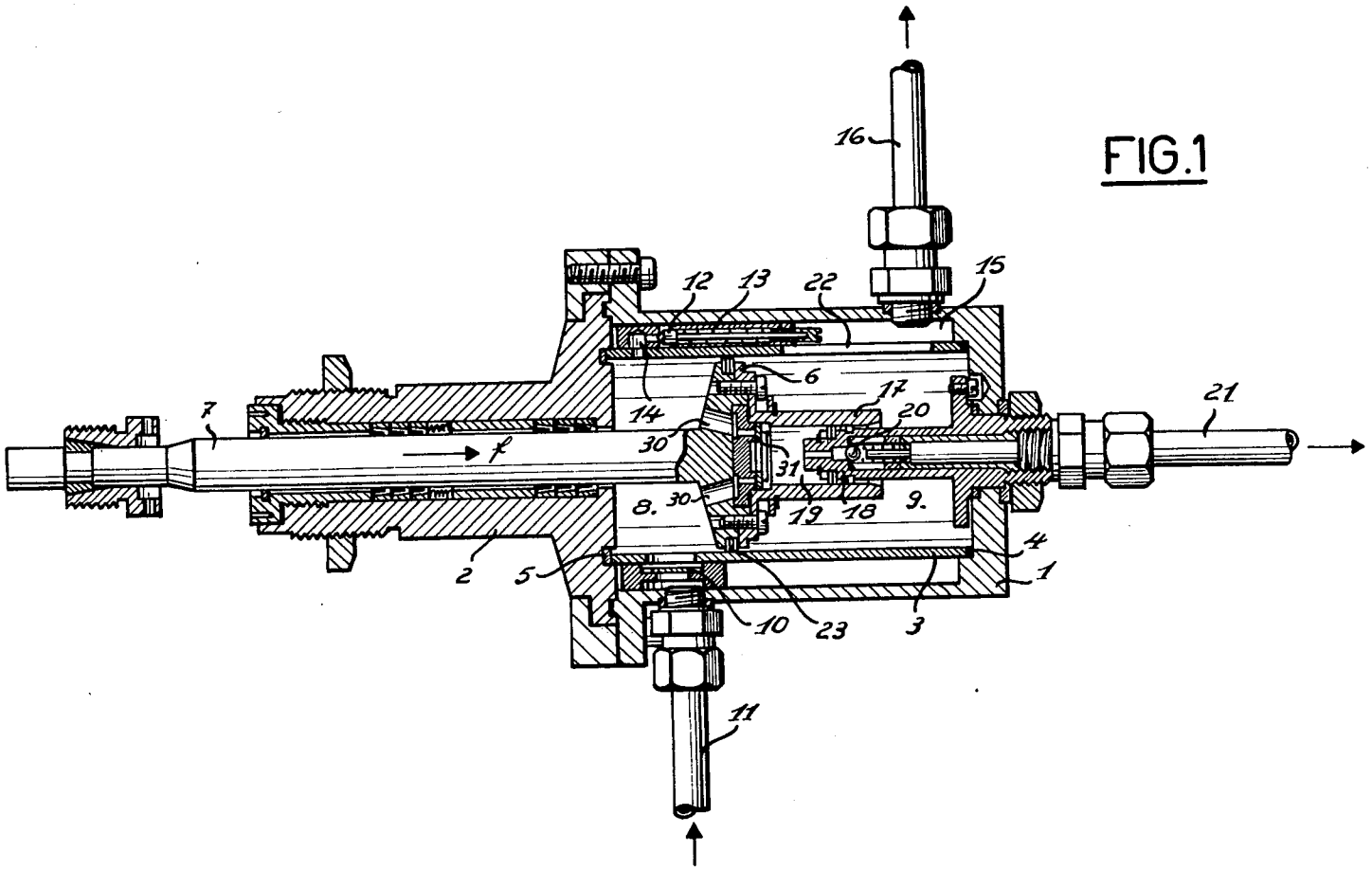
FIG. 1 is a longitudinal cross-section thereof.
Figure 2:
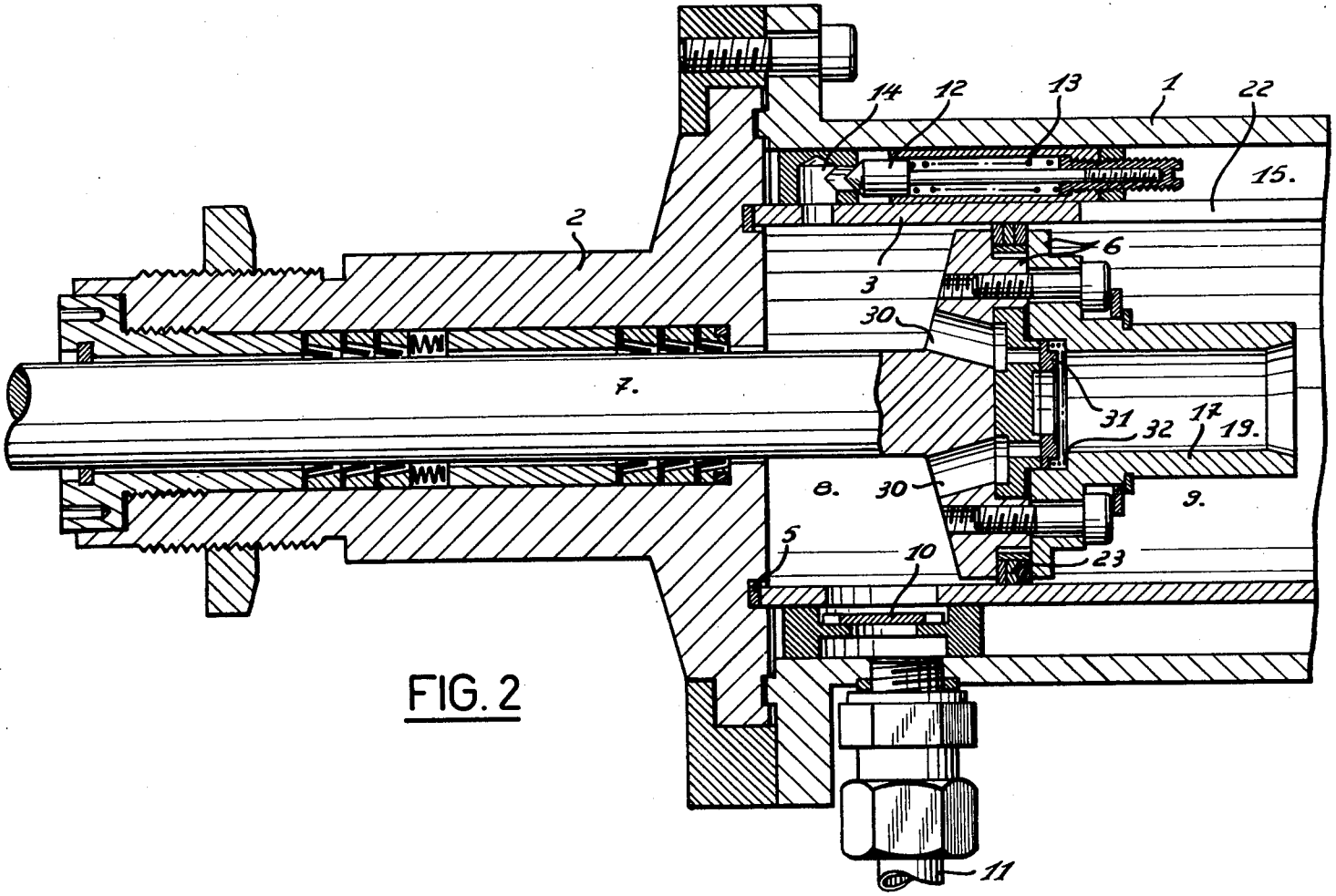
FIG. 2 is a partial longitudinal cross-section thereof on a larger scale.
Figure 3:
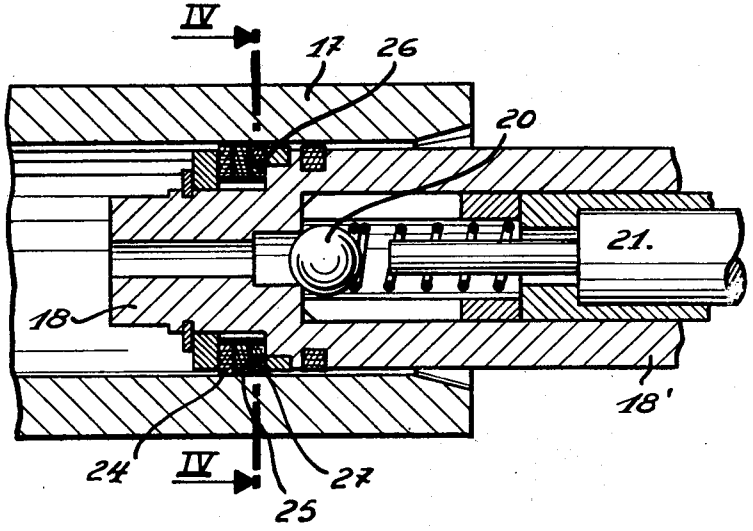
FIG. 3 is a longitudinal cross-section on a larger scale of the fixed piston.
Figure 4:
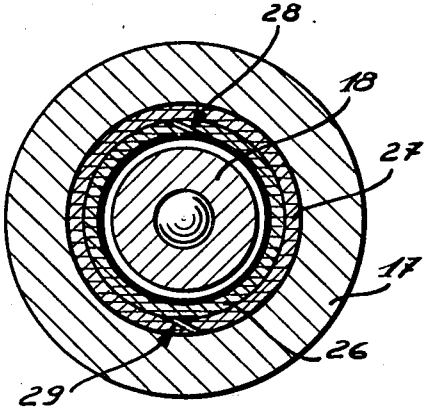
FIG. 4 is a cross-section along line IV—IV of FIG. 3.

The pump for liquid gases shown comprises a frame comprising a housing 1 and a cover 2 defining a cylindrical space within which a cylindrical sleeve 3 is housed concentrically to the housing 1. This sleeve is wedged between a spring washer 4 bearing against the bottom of the housing 1 and a seal 5 resting against the cover 2 and defines thus a cylinder inside the free space of the housing 1.

A movable piston 6, integral with piston rod 7 sliding tightly in the cover 2 and passing through it, separates the cylinder formed by the sleeve into two chambers, a succing chamber 8 and an evacuation chamber 9.

The suction chamber 8 is connected by means of a non return valve 10 to the inlet duct 11 for liquid gas. This non return valve 10 is formed by a disc cooperating with a seat surrounding an opening. When the pressure within the suction chamber is higher than that existing within the inlet duct 11, the non return valve is closed and hinders the entry of liquid gas.

This suction chamber 8 is further connected, through a calibrated valve comprising a needle 12 subjected to the action of a spring 13 housed in a duct 14, to the free space 15 surrounding the sleeve 3, space which freely communicates with an overflow duct 16.

It is to be noted that when the movable piston 6 is in its forward position, towards the right in FIG. 1, the overflow duct 16 is directly connected to the filling duct 11 through the suction chamber 8 and the opening 22 provided in the sleeve 3. Thereby a perfect exhaust of this suction chamber 8 is realized at each reciprocating cycle of the movable piston 6.

The free end of the rod 7 is intended to be connected in a conventional manner to a rotating motor by a crank and connecting-rod system in order to be driven in its reciprocal displacement.

The free face of the movable piston 6 carries a skirt 17, concentric with the sleeve 3, the internal wall of which cooperates with a fixed piston 18, fast with a socket 18' rigidly fixed onto and passing tightly through the bottom of the housing 1. This skirt 17 and this fixed piston 18 define together a compression chamber 19 connected by means of a ball non return valve 20, housed within the channel passing through the socket 19, to an outlet duct 21.

The evacuation chamber 9, surrounding the fixed piston 18 and the skirt 17, is connected, by means of an opening 22 provided in the sleeve 3, to the space 15 and therefore to the overflow duct 16.

The seal between the suction chamber 8 and the evacuation chamber 9 is effected by slotted piston rings 23 which are stacked and maintained at the periphery of the piston 6. These piston rings are for example made out of Tefflon or any other material able to withstand very low temperatures. The sealing between these two chambers need not be absolute; it is thus easy to realize, since the pressure difference between these two chambers is relatively low, about 1 to 10 atmospheres.

The seal between the fixed piston 18 and the skirt 17 is more difficult to realize since there is a great pressure difference, which may be up to several hundreds of atmospheres, and it has to be perfect. This seal is effected by two slotted piston rings 24, 25, stacked against two further concentric piston rings 26, 27 the slots 28, 29, of which are angularly displaced. All these rings are of a material resistant to cryogenic temperatures, for example 100° to 150° C.

Finally the compression chamber 19 is connected to the suction or pre-compression chamber 8, by means of at least one channel 30, here two, closed by a valve made of a ring 31 subjected to the action of a spring 32.

The operation of this pump for liquified gases is as follows:

1. When the movable piston 6 is displaced in the direction of the arrow f, that is towards the fixed piston 18, the following simultaneous operations take place:
   (a) The liquid gas contained in the compression chamber 19 is pushed into the outlet duct 21, the ball 20 displacing itself against the action of its return spring. The valve 31 closes the passages 30.
   (b) The volume of the suction chamber 8 increases, the disc 10 is lifted from its seat and liquid gas enters and fills this suction chamber 8. Due to the low pressure in the suction chamber 8, a certain quantity of gas is vaporized; this has however no importance as will be seen hereinafter.
   (c) The volume of the evacuation chamber 9 decreases and the mixture of liquid gas and gaseous gas contained in said chamber is evacuated through the overflow duct 16 to be recycled. At the end of the stroke of the movable piston 6, the suction chamber 8 is directly connected to the overflow duct 16 ensuring a perfect exhaust of this chamber 8 before the return of the piston 6.
2. When the movable piston 6 is displaced in the other direction, towards the left (FIG. 1), the following simultaneous operations take place:
   (a) Due to the counter-pressure and to its return spring, the non return valve 20 is closed, the outlet duct 21 is closed.

(b) The liquid gas contained in the suction chamber or precompression chamber 8 is compressed, the valve 31 is opened against the action of its spring 32 and the compression chamber 19 is filled with liquid gas under a pressure of 1 to 10 atmospheres which is sufficient to avoid any vaporization of the liquid gas entering into and contained within said compression chamber.

(c) The vaporized liquid gas and the liquid gas contained in excess within the suction chamber are evacuated through the duct 14 and the non return valve 12, 13, the opening pressure of which is higher than that of the valve 31, 32. The duct 14 being located during the operation of the pump, on the highest generatrix of the cylinder formed by the sleeve 3, it is ensured that the vaporized gas does not stay in said suction chamber.

(d) The non return valve 10 is closed by the pressure established in the suction chamber 8.

One sees that thanks to this double stage pump, there is no vaporization of the liquified gas in the compression chamber, said chamber being always filled with liquid under a pressure of some atmospheres. On the other hand liquified gas can be vaporized in the suction chamber; this has however no consequence on the operation of the pump, this gas being evacuated and recycled.

What we claim is:

1. A cryogenic pump for liquid gases, comprising a housing, a cylinder within the housing, a piston reciprocable in the cylinder and dividing the cylinder into a suction chamber and an evacuation chamber on opposite sides of the piston, a one-way valve for admitting liquefied gas into said suction chamber, an overflow duct for exhausting fluid from said evacuation chamber, said overflow duct being permanently and directly connected to said evacuation chamber, said suction chamber being permanently connected to an inlet duct through said one-way valve, a piston rigidly fixed to the housing and extending into said evacuation chamber, a high pressure outlet of said pump extending through said piston, a one-way valve permitting flow of liquefied gas through said outlet only in an outlet direction, a skirt carried by said movable piston and cooperating with said fixed piston to define a compression chamber, a one-way valve permitting flow of liquefied gas through said piston from said suction chamber into said compression chamber, another one-way valve that connects the suction chamber to the overflow duct for evacuation from the suction chamber of that fluid which is in excess of the liquefied gas necessary to fill said compression chamber, and means directly interconnecting said suction chamber with said outlet duct when said piston is adjacent the end of its movement into he evacuation chamber, thereby to exhaust from said suction chamber any said gas which is in vapor phase.

2. A pump as claimed in claim 1, characterized by the fact that the axis of said cylinder is horizontal and said overflow dubt is uppermost.

3. Pump as claimed in claim 1, characterized by the fact that the volume of the suction chamber is greater than that of the compression chamber.

4. Pump as claimed in claim 3, characterized by the fact that the opening pressure of the valve separating the suction chamber from the compression chamber is lower than the opening pressure of the valve connecting the suction chamber to the evacuation chamber.

* * * * *